US007370506B2

(12) United States Patent
Lorieux et al.

(10) Patent No.: US 7,370,506 B2
(45) Date of Patent: May 13, 2008

(54) FORGING DIE WITH MARKING MEANS

(75) Inventors: Alain Lorieux, Sannois (FR); Jean-Jacques Levy, Paris (FR); Daniel Lhomme, Bessancourt (FR); Claude Plazanet, Argenteuil (FR); Pierre George, Ivry/Seine (FR); Camille Cougnaud, Santeuil (FR); Alain Bourgeois, Rueil Malmaison (FR)

(73) Assignee: SNECMA, Paris (FR)

( * ) Notice: Subject to any disclaimer, the term of this patent is extended or adjusted under 35 U.S.C. 154(b) by 270 days.

(21) Appl. No.: 11/091,764

(22) Filed: Mar. 29, 2005

(65) Prior Publication Data

US 2005/0247101 A1 Nov. 10, 2005

(30) Foreign Application Priority Data

Mar. 29, 2004 (FR) ..... 04 03230

(51) Int. Cl.
*B21D 22/00* (2006.01)

(52) U.S. Cl. ..... 72/360; 72/462

(58) Field of Classification Search ..... 72/413, 72/360, 352, 376, 473, 470, 343, 350, 446, 72/448, 462; 29/465; 33/627, 613, 645, 33/626

See application file for complete search history.

(56) References Cited

U.S. PATENT DOCUMENTS

| | | | | |
|---|---|---|---|---|
| 3,762,210 | A | 10/1973 | White | |
| 4,195,510 | A * | 4/1980 | Juergens | 72/350 |
| 4,930,334 | A | 6/1990 | Buehler et al. | |
| 5,083,371 | A * | 1/1992 | Leibfried et al. | 29/889.72 |
| 5,471,923 | A * | 12/1995 | Carroll et al. | 101/32 |
| 7,007,535 | B2 * | 3/2006 | McClung | 72/351 |

FOREIGN PATENT DOCUMENTS

GB 1130962 10/1968

* cited by examiner

*Primary Examiner*—Derris H. Banks
*Assistant Examiner*—Debra M Wolfe
(74) *Attorney, Agent, or Firm*—Oblon, Spivak, McClelland, Maier & Neustadt, P.C.

(57) ABSTRACT

A forging die includes on one face, a half-imprint of a part to be forged such as a turbine engine blade. The die also includes on the face, a device for forming a marking along two directions relatively to which the position of the imprint is defined, the device including two pads protruding relatively to the face and each including two notches defining the two directions. This device preferably includes two pads machined on the die at the same time as the imprint, and each including two notches in the form of a cross.

16 Claims, 1 Drawing Sheet

FORGING DIE WITH MARKING MEANS

BACKGROUND OF THE INVENTION

1. Field of the Invention

The present invention relates to the field of forging metal parts and in particular of complex and warped parts, such as turbine engine blades of large size.

2. Description of the Related Art

For manufacturing metal parts, forging techniques are preferentially applied when they must absorb large stresses in operation. This is the case for compressor or fan blades of turbojets for which the internal stresses are notably generated by the vibrations and centrifugal forces to which they are subject.

Forging consists of plastically deforming a metal bar under the effect of impacts or by applying pressure. Generally, one proceeds stepwise by forming successive blanks which come gradually closer to the finished part. If need be, forging of the part is completed by a calibration phase leading to more accurate shapes.

More specifically, the part is forged by forcing a blank of the latter to be filled by impact or pressure, with an engraved print in a die corresponding to the shape of the part to be obtained. In the case of titanium, as its flow stress strongly depends on temperature, forging is carried out under heat up to a certain limit imposed by the structural change in the material, which modifies its mechanical properties.

The die work operations are generally carried out on mechanical presses with preheated dies. Under these conditions, the forging time is relatively short in order to prevent the part from cooling too fast and the die from heating too much, by thermal conduction between the part and the die itself to the extent that the temperature of the tooling is different from that of the part. Moreover, because of the high level of stresses which it undergoes by contact with the part, a lubricant is deposited on the engraving of the die in order to facilitate flow of the material and to reduce the forging stresses.

The present invention firstly relates to adjusting the tools such as the dies presented above.

The time for making the tools with a conventional method is relatively long as one must proceed with successive touching-up operations.

Indeed, the imprint of the die has not strictly the shape and dimensions of the raw forging part to be obtained. It differs from it by "corrective terms" which compensate the elasto-plastic deformations of the tools during the forging. It is not known how to predict these corrective terms accurately, and therefore the die needs to be touched up, subsequently to the measurements performed on the obtained test parts. In so-called precision forging, the oversizes are small, for example 0.8 mm, so that the finished part may be obtained by polishing the raw part with an abrasive belt or, if need be, notably when it is in titanium, by combining chemical machining and polishing with an abrasive belt. For example, this is the case of the blade of the vanes.

An adjustment of a precision forging die is therefore long and costly, as it requires many touch-up operations separated by part forging tests.

When the die is adjusted, i.e., when the obtained forge raw test parts have the sought-after shape and dimensions, this die may be placed in operation for manufacturing series parts. The die gradually deteriorates during operation, and for example, after 1,000-5,000 parts according to the case, it becomes necessary to restore the die or to use another one.

Restoration of a deteriorated die according to a first method, consists of reloading the areas where material has been taken away, and of machining and polishing a new imprint, i.e., rewashing the die by spark machining. According to a second method, the imprint is entirely reformed by machining after removal of the nitride layer (hardened by surface heat or thermomechanical treatments) and removal of a thickness of a few millimeters of material. This technique is designated under the term of rewashing. Restoration of a die or making a new die requires the same adjustments as the initial die. They are therefore also time-consuming and costly.

SUMMARY OF THE INVENTION

The object of the invention is a means for improving the checking of alignment of dies in order to optimize the adjustment time for forging large series of parts.

According to the invention, the forging die including on one face, a half-imprint of the part to be forged such as a blade of a turbine engine, is characterized by the fact that it includes on said face, a means forming a marking along two directions with respect to which the position of said imprint is defined, said means consisting of two pads protruding relatively to said face and each including two notches defining said two directions.

Preferably, the two notches are positioned in the form of a cross.

According to another feature, the notches are positioned so as to be parallel two by two. In particular, both notches are aligned.

The invention also relates to a method for checking, after machining the imprints, the alignment of two half-dies. According to this method, the position of both side faces of the die is determined relatively to said means forming a marking and if need be, either one of the side faces of one of the dies is rectified. In particular, said positions are determined by probing on a three-dimensional measuring machine (TMM).

The invention also relates to the use of said means forming a marking on the dies in order to check the alignments of die blocks upon mounting them in the forging press. According to a preferred use, a stud in a malleable material is positioned on each of the pads, the studs are crushed between the pads of both dies and the markings made by the notches on the studs are checked.

The invention also relates to the use of said means forming a marking on the dies for checking the alignment of die blocks (during the forging operation for the purpose of recording the relative movements of one die relatively to the other). According to a preferred use, a stud in a malleable material is positioned on each of the pads, the studs are crushed between the pads of both dies and the markings made by the notches on the studs are checked.

BRIEF DESCRIPTION OF THE DRAWINGS

The invention is described in more detail hereafter with reference to the appended drawings wherein.

DETAILED DESCRIPTION OF THE PREFERRED EMBODIMENTS

Figure 1:
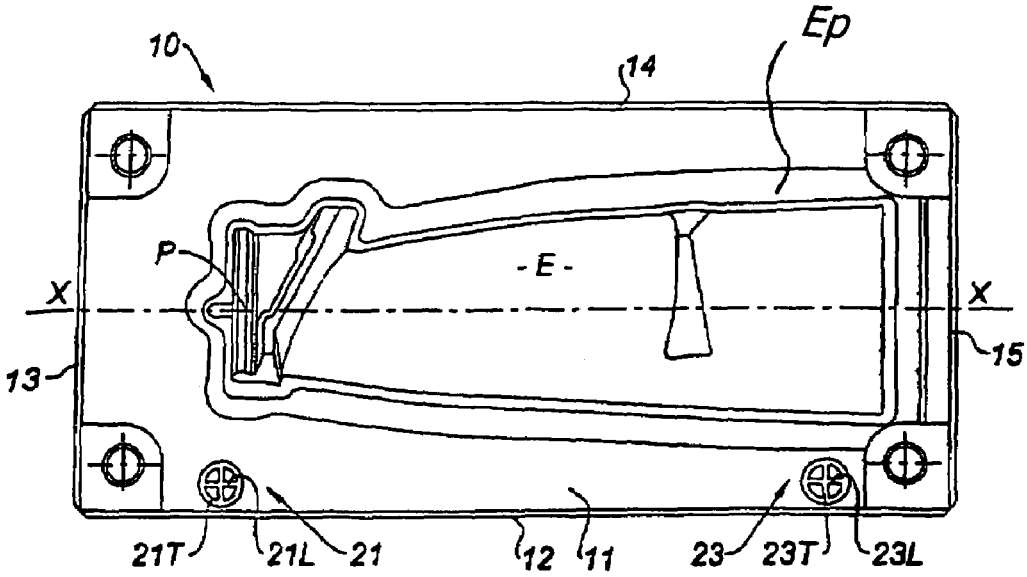
FIG. 1 illustrates a die block as seen from above with means forming markings.

In the figure, a die block 10 for forging a compressor or fan blade of a turbojet is illustrated. The die is in a shape of a block with a rectangular section, the main face of which 11 here comprises the imprint E of a half-blade. This main face 11 is edged by four side faces 12, 13, 14, 15. The shape of the imprint is defined by appropriate calculating means and is achieved by machining or spark machining or any other means known to one skilled in the art. For example, it is achieved either on a numerical control machining center, or on an electro-discharge machine (EDM). Around the imprint, a peripheral area Ep is generally provided for forming a land, as known in this field. The embodiment of the imprint is not part of the invention. The engraving comprises a main axis XX and at least one reference point P forming the origin for machining the imprint. The geometry of the imprint is thereby defined relatively to both of these longitudinal and transverse references. The longitudinal side faces 12 and 14 are parallel to axis XX. The transverse faces 13 and 15 are perpendicular to it.

The complete die for forging the part comprises a second block with the imprint of a half-blade with a complementary shape to the previous one. For forging the part, both blocks are placed and fixed in the platens of a press, a lower platen and an upper platen. The blank of the part to be forged is positioned in the lower die block and the press is operated. By getting closer to each other, both blocks deform the blank unit, the part with the shape defined by the imprints is obtained, with a complete flash on its perimeter.

The forging quality partly depends on proper positioning of both imprints relative to each other at the instant of striking. The latter positioning depends both on proper positioning of the imprints in their respective die block and on proper positioning of both blocks relatively to each other.

With the device of the invention, it is possible to achieve this result, simply and effectively.

Figure 2:
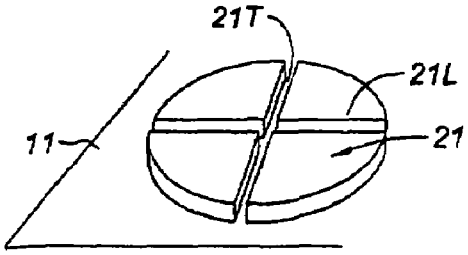
FIG. 2 shows the detail of a pad forming a marking.
Figure 3:
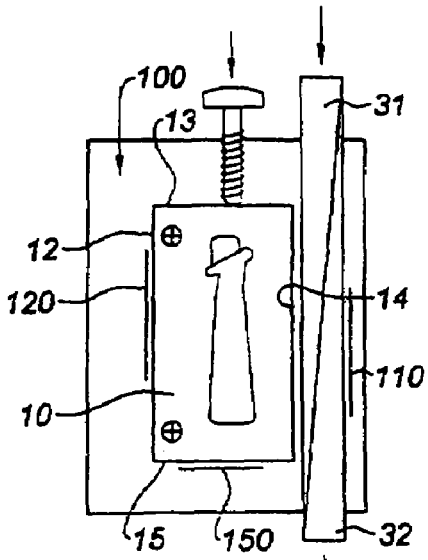
FIG. 3 shows the mounting of a die block on the platen of a press.

According to the invention, with imprint E, two pads 21 and 23 are made by engraving. Both of these pads protrude relatively to the upper face 11 of the block. Both pads are here disc-shaped but they may assume another shape. An enlarged view of the pad 21 is illustrated in perspective in FIG. 2. Each pad comprises two notches at right angles 21L, 21T and 23L, 23T, respectively.

Both longitudinal notches 21L and 23L are made parallel to the axis XX of the imprint, at a predetermined distance. Here, both notches are at a same distance from axis XX. They are therefore aligned. The transverse notches 21T and 23T are perpendicular to the previous ones and each at a predetermined distance from the reference point P. The positions of the imprint and of the notches are thus perfectly defined in space, relatively to each other.

With these means 21 and 23, the checking of the position of the imprint on the die block on the one hand and the visual checking of proper alignment of the die blocks during the forging operations on the other hand;

may be carried out.

As for the first checking operation, once the die is machined, the position of pads 21 and 23 relatively to the side faces, 12, 14 and 13, 15 is measured by probing, for example on a three-dimensional measuring machine TMM. It is thus checked for each of the two die blocks, that faces 12 and 14 are properly parallel to the direction of notches 21L and 23L and at a proper distance from the latter on the one hand, that faces 13 and 15 are properly parallel to the direction of notches 21T and 23T and at a proper distance from the latter on the other hand.

If a deviation is noticed relatively to the theoretical dimension on one of the two dies, one proceeds with rectification on side face(s) of one of the dies in order to make said distances identical on both of the die blocks.

If a deviation is noticed relatively to the theoretical dimension on each die, one proceeds with rectification on the die with the smallest flaw.

In this way, dies are obtained for which the imprints are aligned flawlessly. The use of such pads provides a rapid check with high measuring precision.

Once made, the blocks are mounted on the platens of the press. Mounting is performed by tightening the side faces of the blocks against stop surfaces 120 and 150. A top view of a press platen 100 is illustrated schematically. For example, the positioning of the side faces 12 and 14 is adjusted by means of so-called "sloped" t wedges 31 and 32. These wedges have the shape of dihedrals and are positioned so as to have two parallel faces and two tilted faces relatively to the latter, in contact with each other. By moving a wedge relatively to the other, parallel to their parallel faces, the latter are moved apart or brought closer to each other. Both wedges are pressed, one against the side face 14 of the block, the other one against a stop 110 integral with the platen. The other side face 12 of the block will press against a stop 120 integral with the platen. This sloped wedge system therefore allows the block to be moved perpendicularly to faces 12 and 14; an adjustment in position on the platen is thereby possible in a transverse direction. If need be, metal strips are positioned between the wedge 120 and the side face 12.

For adjusting the position in the longitudinal direction, a screw is available which presses on face 13 and repels the block against a stop 150 integral with the platen. The position of the die block may also thereby be adjusted in the longitudinal direction. A metal strip may be placed if necessary between the side face 15 and the stop 150.

In order to check the respective position of both dies, one proceeds in the following way.

A PB lead stud or another malleable material is deposited on each of the two pads of the lower die and the upper die is lowered until it crushes both studs.

Figure 4A:
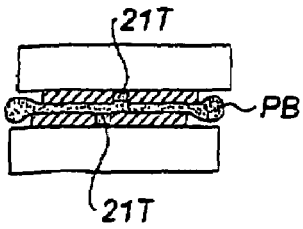
FIGS. 4A and 4B show the checking studs between the pads before crushing.
Figure 4B:
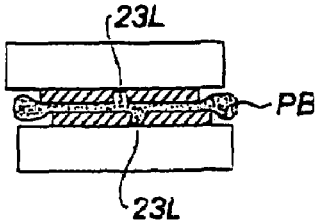

Both studs are illustrated in FIGS. 4A and 4B after crushing, in position between the pads.

The operator may easily check that the notches 21T (or 23T) of both upper and lower pads are not aligned in the illustrated example. By bringing back the thereby deformed stud into a measuring apparatus, he/she may determine with precision the rectification to be made in the longitudinal position.

Similarly, he/she checks by observing the notches 23L (or 21L) that both blocks are not properly positioned transversely.

Thus accurate and marking means, simple to apply, are made available, from which, if need be, corrections required for proper positioning of the imprints relatively to each other may be made.

With these means, it is possible to also check the effects of rotation of the dies under the forging stress during the first use of the dies, by proceeding with checking with the studs at the same time as one proceeds with striking a part.

One proceeds with this checking after each machining or re-machining of an engraving, and for each beginning of a forging campaign.

Finally, with the studs, it is possible to check the gap between the upper and lower dies after the striking, relatively to the desired thickness of the land.

The invention claimed is:

1. A method of mounting dies in a forging press, said method comprising the steps of:

checking alignment of two pads of a forging die upon mounting said forging die in the forging press, wherein said forging die includes on a face, a half-imprint of a part to be forged and a marker on said face, said marker providing a marking along two directions relatively to which a position of said imprint is defined, said marker including said two pads protruding relatively to said face, each pad including two notches defining said two directions, positioning a stud in malleable material on each of the pads, crushing the studs between the pads of both dies and checking the markings provided by the notches on the studs.

2. A die for forging a blade of a turbine engine, said die comprising:

a block with an imprint of a half-blade, said block having a top face, a bottom face, a first side face and a second side face opposite said first side face, said imprint extending between said first and second side faces along a main axis of said imprint;

wherein said block includes a first notch that is closer to said first side face than to said second side face and a second notch that is closer to said second side face than to said first side face;

wherein said first and second notches are parallel to each other and to said main axis of said imprint, wherein said first and second notches are at a same distance from said main axis of said imprint and are on a same side of said main axis of said imprint so as to be aligned with each other.

3. The die according to claim 2, wherein said half-imprint is of a blade of a turbine engine.

4. The die of claim 2, wherein said first and second notches are perpendicular to said first and second side faces.

5. The die of claim 2, wherein said first and second notches are not continuous with each other such that said block is free of any notch between said first and second notches.

6. The die of claim 2, wherein said block includes a third notch and a fourth notch, said third and fourth notches being perpendicular to said first and second notches.

7. The die of claim 6, wherein said third notch is at a predetermined distance from a reference point for said imprint and said fourth notch is at another predetermined distance from said reference point.

8. The die of claim 6, further comprising another block with another imprint having a shape complementary to the half-blade, wherein said another block includes notches, each notch of said another block being positioned so as to be aligned with one of said first, second, third and fourth notches when said block and said another block are pressed against each other.

9. The die of claim 6, wherein:

said first and second notches are perpendicular to said first and second side faces, said block has a third side face extending from said first side face to said second side face and a fourth side face opposite said third side face and extending from said first side face to said second side face, and said third and fourth notches are perpendicular to said third and fourth side faces.

10. The die of claim 9, wherein said third and fourth notches are not continuous with each other such that said block is free of any notch between said third and fourth notches.

11. A for forging a blade of a turbine engine, said die comprising:

a block with an imprint of a half-blade, said block having a top face, a bottom face, a first side face and a second side face opposite said first side face, said imprint extending between said first and second side faces along a main axis of said imprint;

wherein said block includes a first notch that is closer to said first side face than to said second side face and a second notch that is closer to said second side face than to said first side face;

wherein said first and second notches are parallel to each other and to said main axis of said imprint, wherein said first and second notches are at a same distance from said main axis of said imprint, wherein said block includes a third notch and a fourth notch, said third and fourth notches being perpendicular to said first and second notches, and wherein said third notch crosses said first notch and said fourth notch crosses said second notch.

12. The die of claim 11, wherein said third notch crosses said first notch at midpoints of said first and third notches and said fourth notch crosses said second notch at midpoints of said second and fourth notches.

13. The die of claim 12, wherein said block comprises a first and a second pad, said first pad protruding from a surface of said block and defining said first and third notches, and said second pad protruding from the surface of said block and defining said second and fourth notches.

14. The die of claim 13, wherein said first and second pads are disc-shaped.

15. A die for forging a blade of a turbine engine, said die comprising:

a first block with an imprint of a half-blade, said block having a top face, a bottom face, a first side face and a second side face opposite said first side face, said imprint extending between said first and second side faces along a main axis of said imprint; and another block with another imprint having a shape complementary to the half-blades, wherein said first block includes a first notch that is closer to said first side face than to said second side face and a second notch that is closer to said second side face than to said first side face;

wherein said first and second notches are parallel to each other and to said main axis of said imprint, wherein said first and second notches are at a same distance from said main axis of said imprint.

16. The die of claim 15, wherein said another block includes notches, each notch of said another block being positioned so as to be aligned with one of said first and second notches when said block and said another block are pressed against each other.

* * * * *

UNITED STATES PATENT AND TRADEMARK OFFICE

CERTIFICATE OF CORRECTION

PATENT NO. : 7,370,506 B2
APPLICATION NO. : 11/091764
DATED : May 13, 2008
INVENTOR(S) : Alain Lorieux et al.

It is certified that error appears in the above-identified patent and that said Letters Patent is hereby corrected as shown below:

Column 6, line 9, after "A" (first occurrence) insert --die--,
line 49, change "half-blades" to --half-blade--.

Signed and Sealed this

Sixteenth Day of December, 2008

JON W. DUDAS
*Director of the United States Patent and Trademark Office*